US006305088B1

(12) United States Patent
Novinger et al.

(10) Patent No.: US 6,305,088 B1
(45) Date of Patent: Oct. 23, 2001

(54) SCISSOR CUTTING EDGE SAFEGUARD

(76) Inventors: Harry E. Novinger, 13890 E. Marina Dr. #609, Aurora, CO (US) 80014-3760; Gary D. Novinger, 2086 S. Salida St., Aurora, CO (US) 80013; Carla S. Howey, 13132 W. Florida Dr., Lakewood, CO (US) 80228-3743; Nancy K. Novinger, 6320 S. Newport Ct., Englewood, CO (US) 80111

( * ) Notice: Subject to any disclaimer, the term of this patent is extended or adjusted under 35 U.S.C. 154(b) by 0 days.

(21) Appl. No.: 09/514,850

(22) Filed: Feb. 28, 2000

Related U.S. Application Data

(60) Provisional application No. 60/139,081, filed on Jun. 14, 1999.

(51) Int. Cl.[7] ..... B26B 13/00; B21K 11/06

(52) U.S. Cl. ..... 30/254; 30/357; 76/106.5

(58) Field of Search ..... 30/131, 233, 254, 30/286, 357; 76/104.1, 106.5; D8/57

(56) References Cited

U.S. PATENT DOCUMENTS 3,196,540 * 7/1965 Porzky ..... 30/254
3,325,897 * 6/1967 Luebkeman ..... 30/254
4,422,240 * 12/1983 Wallace et al. ..... 30/254
4,709,480 * 12/1987 Takigawa et al. ..... 30/254

FOREIGN PATENT DOCUMENTS

3344863 * 7/1984 (DE) ..... 30/254
726192 * 3/1955 (GB) ..... 30/254

* cited by examiner

*Primary Examiner*—Hwei-Siu Payer

(57) ABSTRACT

A pair of scissor blades illustrated in (FIG. 4); each blade comprising a cutting edge (3) arranged below a blade protuberance relative to the direction of the cutting stroke. The protuberance comprises a cutting edge grinding surface (4), a pressing ridge (5) and a blade side surface (6). The protuberance presses on skin creating sensitive reactions in the user prior to the rear located cutting edge damaging the skin. The cutting edge degree of sharpness is predetermined at the factory. A method of manufacturing the invention and for modifying standard prior art scissor blade shapes by grinding a cutting edge at a new angle of sharpness that inherently produces the safeguarding blade protuberance.

11 Claims, 1 Drawing Sheet

8
1A
1
4
5
6
1B
9
3
3
9
6
5
4
2
2B
8
2A
10

7
1
9
3
3
9
2
7

6
5
4
3
2
8
9
7

1BB
1
2
1A
1B
2A
2B
2BB
2
2

6
5
4
11
9
3
2
8

6
5
4A
3A
2

6
5
4B
11
3B
2

6
5
4C
11
3C
2

6A
11
3D
2
8A 5A
4A
6B
3A
2E
9A
8B

SCISSOR CUTTING EDGE SAFEGUARD

This application is a continuation of U.S. Provisional Application Ser. No. 60/139,081, filed on Jun. 14, 1999

BACKGROUND

1. Field of Invention

This invention relates to an improvement in scissor blade safety, specifically to the scissor blade's cutting edge location. Relative the leading, front portion of the blade, and to the shape of the leading portion taken in the direction of the cutting stroke. Application 2. Discussion of Prior Art All prior art scissors found by inventor easily cut skin, flesh, because the first portion of the blade is the cutting edge. Self use of scissors for cutting hair in hard-to-see areas of body is a dangerous act. No prior art provides a suitable safeguard along the cutting edge to mitigate harm by a person in difficult to reach or to see for self-use. No safeguard exists for young children's use of scissors.

All prior art cutting edge angles of sharpness are ground with potentially sharp, reflex cutting angles ranging from the least sharp angles of 270 degrees to beyond the very sharp 330 degrees, even close to razor sharpness angles. All angles were taken at distances out from the cutting edge measured within one millimeter (mm) of edge.

This invention provides less sharp, safeguard blade structure for sharpness cutting angles under 270 degrees.

SUMMARY

The invention provides scissor blade structure for safeguard blade protuberances arranged in front of the cutting edge, in the cutting stroke direction of the blade, and extending substantially parallel and substantially the length of the cutting edge. The protuberance provides the guarding by pressing against skin or flesh substantially prior to the sharp cutting edge reaching the skin or work piece, which may include flesh. This protruding structure creates sensitivity when it touches skin, whereby continued or increasing pressure is perceived by the user as harmful.

The structure also provides many different scissor blade cutting edge angles of sharpness that are far safer than the 270 degrees and higher degree angles common to prior art scissors.

The combinations of these different angles with the different areas and positions of the protuberances provide a multiplicity of scissor blade shapes, lengths, and resulting uses the prior art cannot meet with the great protective safety of this new scissor art.

The invention also provides a very cost-effective method for manufacturing each of the new arrangements resulting from combining different cutting edges and protuberant shapes, simultaneously with one grinding in most configurations.

This method also generally applies for modifying the many different prior art blade shapes before original sharpening or after original sharpening by creating the new protuberances and cutting edge physical features of the apparatus claims.

OBJECTS AND ADVANTAGES

The main object of this invention is to provide, for the first time, improved safety in the use of scissors close and on human skin, flesh by greatly mintigating the prior art usual pinching and cutting of tender, soft, uneven skin by sharp cutting edges when children use scissors, and when adult users cut their own hair in difficult-to-reach, unseen areas such as in the nose, ear, and behind the neck.

Other objects include: these same scissors with safety protective features also are able to easily and effectively cut paper, cloth, hair, and other work pieces while having the sizes, weights, and handling characteristics of typical types of scissors in the prior art.

Further objects and advantages of my invention will become apparent from study of the drawings and specification.

DESCRIPTION OF DRAWINGS

FIG. 4 scale is at 40 magnifications greater than FIGS. 1 and 2.

DESCRIPTION OF INVENTION

Figure 1:
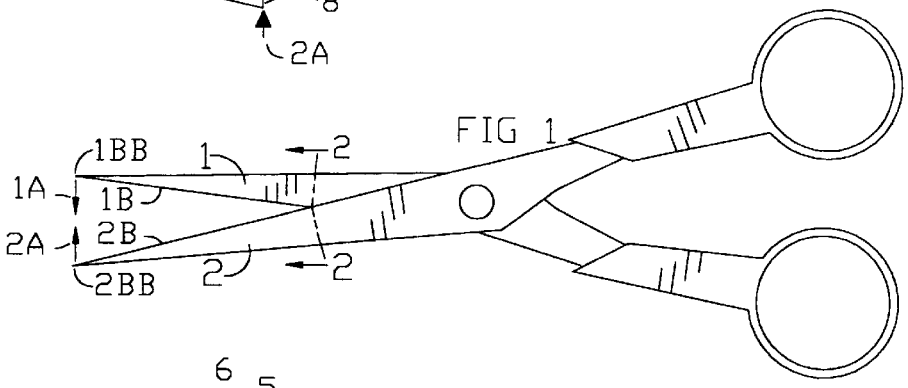
FIG. 1 is a side view of a typical, small pair of scissors at a usable scale size. The invention, without magnification, resides within the lines of the drawing of the blades because the invention comprises physical structures smaller than the lines in this side view.

FIG. 1 shows a side view at usable scale of a typical pair of scissors for cutting work pieces of hair, paper, thin cloth, and other items a child or senior age adult may use. Blade 1 and a blade 2 have their cross sections taken at 2–2 for expansion 40 times as a pair in FIG. 4. Blade 1 exposes its faceside while Blade 1 faceside isn't seen in FIG. 1. All the embodiments of the invention reside in the scissor blades. Their positions to one another are identified relative the arrows 1A and 2A that indicate the respective directions of each blade in their cutting strokes.

The cutting stroke direction determines the relative locations of each blade's arrangement of its leading, front portion which includes blade leading portion 1B of Blade 1 and leading portion 2B of Blade 2. Both these portions substantially extend along the full length of each blade and can extend around the blade tip for further safety. FIG. 1 also shows Blade 1 with blade tip 1BB and Blade 2 with blade tip 2BB.

Figure 2:
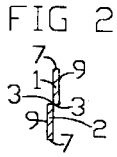
FIG. 2 is a cross-sectional view, of blades 1, 2 in FIG. 1, taken at 2—2 and is at the same scale as FIG. 1. This micro-size invention is mostly hidden within the feature 3, which is to identify the corner area occupied by two additional elements of the invention.

FIG. 2 shows a cross-section of Blade 2 taken at 2—2 in FIG. 1. At this actual size of scissor Blade 2, the micro-size dimensions of the main elements comprising the invention are hidden in the corner of Blade 2 of FIG. 2 which is identified by Feature 3. A blade bottom Side 7 and a Side 9 are the only sides identified for comparison to FIG. 3. Blade 2 width is substantially 1.3 mm in this small size blade. FIG. 2 also shows Blade 1, but for clarity refer to FIG. 4, at 40 magnifications.

Figure 3:
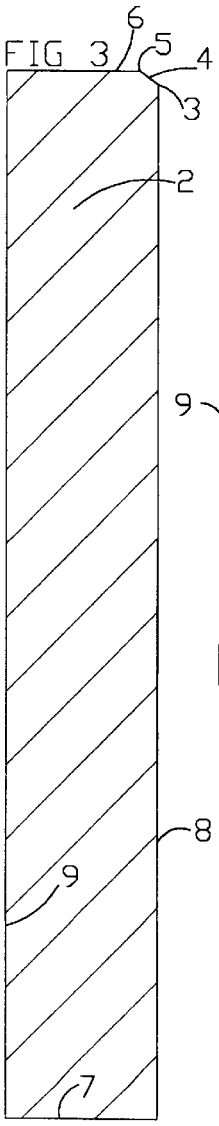
FIG. 3 is an expanded sectional view of blade 2 in FIG. 2. It has been expanded to a scale of 20 magnifications greater than FIG. 2. This bigger scale is to visibly show the area identified as Feature 3 in FIG. 2. The Features 3, 4, 5, 6 comprise the main elements of the invention.

FIG. 3 is a magnification 20 times larger than FIG. 2 so as to visibly show the arrangements of the invention and all other features of Blade 2. The main elements are: a blade cutting edge 3 is located under or behind a cutting edge grinding surface 4 reading on cutting stroke 2A direction. In front of grinding surface 4 is a pressing ridge 5, which is a joint formed by the leading or front blade side 6 where it joins the leading portion of grinding surface 4. The lower, rear portion of surface 4 forms one side of cutting edge 3. Side 8 forms the other side of cutting edge 3. Edge 3 is a joint where 4 and 8 join.

The reflex angle of this cutting edge 3 is substantially 225 degrees in FIG. 3. When grinding surface 4 was ground, the grinding produced a new structure in scissor art. That structure is the main blade 2 protuberance defined by grinding surface 4, pressing ridge 5, blade side 6 and top portion of a side 9. This new type blade structure is a protuberance located in front of the improvement's new rear location of blade cutting edge 3. These elements comprise the leading portions of blades 1 and 2 of FIG. 1 and are indicated by 1B and 2B. They are relative to cutting strokes 1A or 2A directions. This new protuberant structure is usually the first to touch, press against skin or other work piece. The main purpose of the invention's protuberance is its protective, safeguard type features which may be smooth, rounded for gliding over or around uneven skin rather than the sharper cutting edges of scissors that all prior art provides. These features provide early warning to user that cutting is likely to follow if the user fails to change the scissor blade paths or pressure. They include:

A blade surface 8 in FIG. 3 is the face side of blade 2. This side faces blade 1 in FIG. 1. Side 8 is at opposite side of side 9. Opposite to side 6 is a side 7. The elements 3, 4, 5, are difficult to observe in FIG. 1 scale, and the long, narrow grinding surface 4 is not easily seen on the scale of FIG. 1 except when turned against a light source to obtain a reflection. This surface 4 extends to end of blade 2 and may wrap around the pointed end of blade when desired for safety.

Figure 4:
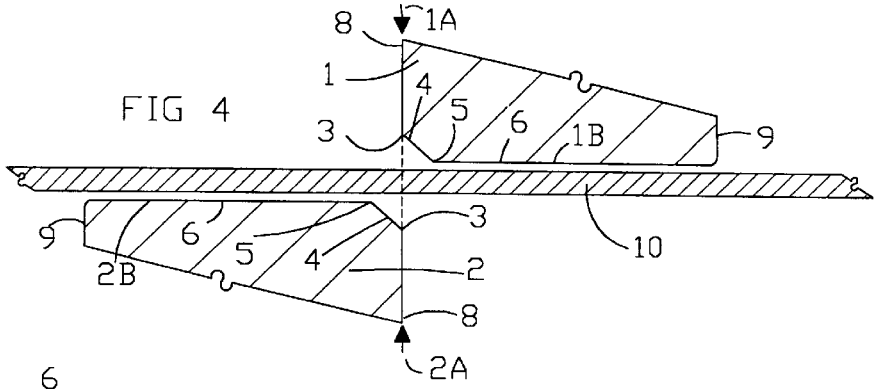
FIG. 4 is a partial cross-section of both scissor blades, taken at 2—2 of FIG. 1 reading on FIG. 2, and at double the scale of FIG. 3.

FIG. 4 shows partial sections of blades 1 and 2, taken at 2—2 in FIG. 1 and here magnified 40 times for clarity and study as a pair of blades approaching each side of a sheet of typing or copy paper work piece 10. This work piece is at 40 magnifications.

The same feature numbers in both blades of FIG. 4 demonstrate that all elements may be similar in both blades. The work piece could be hair, cloth and other small items suitable for the child scissors size illustrated in FIG. 1. FIG. 4 shows the cutting stroke directions of each blade by arrows 1A and 2A.

The cutting stroke is carrying the two cutting edges 3 toward work piece 10. If the work piece surfaces were skin with hairs, the hairs would now be stimulating adjacent nerves by the touch of the pressing protuberances. Without hair, a further slight movement of a protuberance toward skin may touch skin and stimulate nerves.

These protuberances, in the blade shapes in FIGS. 4–8, include all the elements in the blade leading portions of 1 B and 2B except the cutting edges 3. Thus, 1B and 2B include grinding surfaces 4, pressing ridges 5 and sides 6 in blades 1 and 2 of FIG. 4. Grinding action produced surface 4 and created cutting edge 3 below the blade leading portions relative the stroke directions.

OPERATION OF INVENTION

The expanded scale of FIG. 4 illustrates the leading portion elements; the cutting edge grinding surface 4, pressing ridge 5 and blade side 6. These elements comprise the blade protuberance of each blade. It is the protuberances that simultaneously press on both sides of work piece 10 prior to any cutting by cutting edges 3. When 10 is skin, the user's amount of pressure, nerve stimulation, or pain should guide the location of the blades and amount of damage, if any. This safeguard control does not exist in the structure of prior art scissors, because the leading portions of prior art blades are the sharp cutting edges, not these protuberances.

This leading blade portion that protrudes in front of the cutting edge of each blade is the essence of this invention. Its contribution to safe scissor use on skin of inventor has always produced protective reactions, even with slight touching. Varying amounts of pressure felt by nerve receptors provide warning sensations automatically guiding the control of the scissors.

Figure 5:
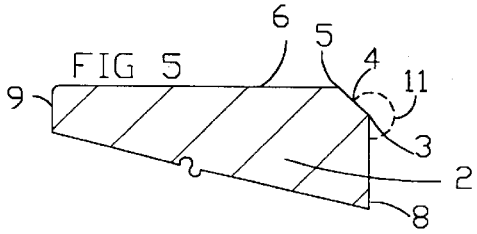
FIGS. 5, 6, 7, 8, 9, 10 are partial sectionals at same scale as FIG. 4. These show some of the multiplicity of the possible embodiments of the invention.

A predetermined amount of control can be built in the type of scissor use intended. In children types, less sharp angles of cutting edge sharpness can be adapted as cutting edge 3C in FIG. 8 illustrates. Its angle is about 210 degrees. For adult use, the angle may be much sharper, as in FIG. 7 at 3B which is about 240 degrees. The 225-degree sharpness angle at edge 3 in FIG. 4 and FIG. 5 is my all-purpose angle choice. Even with my crude grindings, my friends find this angle to be far safer than their old prior art scissors and cuts cloth, cardboard, ribbons, and other work pieces easily.

FIGS. 5–10 show a few samples of the many different arrangements possible when combining the many different shapes of the protuberances with the many different shapes of cutting edge angles of sharpness. Even the flat side 6 in FIGS. 4–8 can be curved without changing the pressing ridge 5 shape. Ridge 5 can be dulled as needed.

The sharpness angle of cutting edge 3 in FIG. 5 is indicated by the degree Rose 11. This rose was eliminated on earlier figures for clarity of element shapes. Cutting Edge 3 has a sharpness angle of about 225 degrees as does Edges 3 in FIGS. 3–4.

In all cases, this invention provides cutting edge angles of less than 270 degrees. Prior art cutting angles have not been found less than 270 degrees. All measurements have been made within one-MM distances from the ridge of each cutting edge at center of Rose 11. The radius of the rose has been changed to fit the different placements of lines and numbers in different figures.

Figure 6:
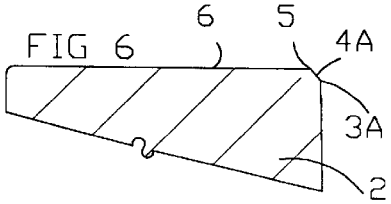

FIG. 6 shows cutting edge sharpness same as in FIG. 5 but has cutting edge grinding surface 4A only half the width of surface 4 in FIG. 5. Thus, 4A provides less safety for edge 3A by less distance from ridge 5 and side 6 for the protection of user.

Figure 7:
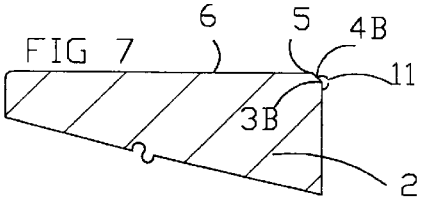
Figure 8:
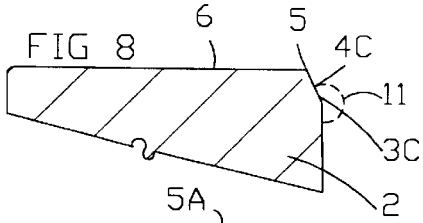

FIG. 7 shows a sharper cutting edge 3B. It is about 240 degrees but may be close to 269 degrees to stay under the widely used sharp cutting edge of the prior art configuration of 270 degrees at Rose 11 in FIG. 9 at 3D cutting edge. Grinding surface 4B provides the sharper cutting edge 3B.

FIG. 8 shows a cutting edge 3C, which has a very dull sharpness angle. However, when paired with another blade and both having coarse grit sharpened edges, the dullness is not apparent. Grinding surface 4C provides the decreased cutting edge angle 3C.

Figure 9:
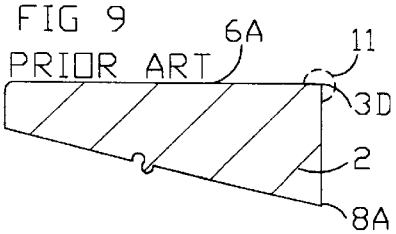
FIG 9 PRIOR ART

FIG. 9 shows the typical shape of some prior art blade shapes with 270 degrees cutting edges at 3D. It is illustrated only for comparison with my other figures. This blade shape was easily converted to the other figures by grinding off edge 3D, thereby converting FIG. 9 to FIGS. 5, 6, 7, 8; a very simple method of manufacturing my invention. Elements 6A and 8A have not been ground to form a new cutting edge in FIG. 9.

Figure 10:
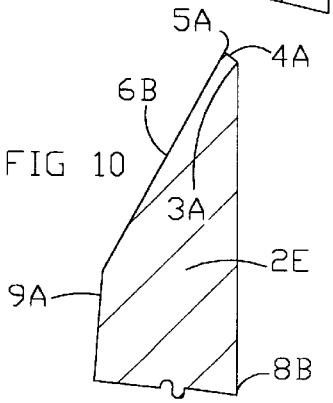

FIG. 10 shows a common type blade 2E with a leading portion 6B far more narrow than the other figures. I modified it by grinding off the original very sharp cutting edge with about 3 movements of the hand-held sharpening tool. This formed the new cutting edge, shorter face side 8B and grinding surface 4A which also produced a new cutting edge 3A of same shapes as in FIG. 6, and a new pressure ridge 5A. As ridge 5A was too sharp, 1 rounded it off a small part of one MM until it did not cut with considerable pressure. This blunting of 5A in FIG. 10 is hidden in the lines of drawing which are 40 times wider than the actual ridge 5A rounded surface.

CONCLUSIONS

Very cost-effective manufacture of the protective protuberance simultaneously with inherent provision of different sharpness angles of cutting edges makes this invention readily available. The Industry's long sought but never before attained safer type scissors now is provided by this unique new structure.

I believe the invention includes still further advantages. Extremely narrow widths of grinding surfaces 4A in FIG. 6, when using the less sharp cutting edge 3C in FIG. 8, in my final tests, produced a new class of successful results. They are difficult to see and measure. They can be seen using low power magnification. When a coarse grit tool was used to grind 3A in FIG. 6 close to the very low angles of around 200 degrees of 3C of FIG. 8, the results were improved; and when the sliding pressure was increased it was further increased. The skin bites were sharper suggesting cuts eminent but no breaks in my skin. This suggests these combinations of microstructures with coarse grit grindings may provide superior service, while maintaining safeguard effectiveness over the larger dimensions.

The above descriptions should not be construed as limitations on the scope of the invention because other variations are possible as my tests above suggest.

Accordingly, the scope of the invention should be determined not by the embodiments illustrated, but by the appended claims and their legal equivalents.

We claim:

1. A pair of scissors comprising two blades for cutting a workpiece during their cutting strokes, comprising:

at least one of said blades further comprising;

a. cutting edge extending substantially the length of said at least one blade for cutting the workpiece, a face side comprising one side of said cutting edge and extending substantially the length of said cutting edge, a blade leading portion of said at least one blade determined relative the direction of said blade cutting stroke, said blade leading portion comprising;

a protuberance comprising, a leading side of said at least one blade, a grinding surface disposed between said leading side and said cutting edge, a pressing ridge formed by said grinding surface joint with said leading side, and said protuberance arranged in front of said cutting edge whereby said protuberance presses against the workpiece, prior to said cutting edge cutting the workpiece, whereby the protuberance causes sensory perception of harm, when the workpiece is human flesh, alleviating cutting by said cutting edge.

2. The scissors of claim 1, and wherein; said cutting edge comprises a degree of sharpness less than a reflex angle of substantially 270 degrees for less sharpness and greater safety.

3. The scissors of claim 2, and wherein; said protuberance extends a predetermined amount around the end of said at least one blade.

4. The scissors of claim 3, and wherein; said grinding surface is ground by a rough grinding tool.

5. The scissors of claim 1, and wherein; said pressing ridge is rounded.

6. Apparatus for cutting a workpiece during a cutting stroke comprising two blades, each comprising a cutting edge, for cutting said workpiece;

said blades each comprising means, extending substantially along the full length of each said cutting edge, for pressing against said workpiece; and, each said cutting edge positioned behind said means for pressing said workpiece relative the direction of said cutting stroke, whereby when said workpiece is human skin said pressing means creates a sense of harm in said skin prior to said cutting edge reaching said skin for increased safety of using said apparatus.

7. The apparatus of claim 6, and wherein;

said means for pressing against said workpiece comprising a protuberance in the leading portion of each said blade relative the direction of said cutting stroke; and, said protuberance comprising a cutting edge grinding surface, a pressure ridge and a blade side.

8. The apparatus of claim 7, and wherein; said cutting edge comprises a reflex angle of less than 270 degrees.

9. A method for manufacturing a scissor blade made from blade stock comprising a leading side determined by the blade cutting stroke direction and a face side comprising the operation of:

grinding-off an edge of said leading-side joining said face side at a reflex angle of less than 270 degrees with respect to both said sides' joint; thereby creating a cutting edge located in a new position below said leading side, relative to said cutting stroke direction, and whereby said leading side can press against a work piece prior to said created cutting edge reaching said workpiece.

10. A method of manufacturing an improvement in at least one scissor blade in a pair of scissors, and said blade comprising a leading side (6) determined by the cutting stroke direction and a face side (8), both said sides forming a joint, and the method comprising the operation of:

grinding-off said joint including predetermined portions of said leading side and said face side whereby said operation of grinding-off provides a blade cutting edge comprising a predetermined reflex angle of less than substantially 270 degrees, measured within one mm on both sides of said cutting edge.

11. The method as recited in claim 10, and wherein;

said grinding-off operation further provides a protuberance arranged ahead of said cutting edge comprising the remaining portion of said leading side (6), a pressing ridge (5) and a grinding surface (4).

* * * * *